US011078911B2

(12) United States Patent
Ueda et al.

(10) Patent No.: US 11,078,911 B2
(45) Date of Patent: Aug. 3, 2021

(54) ROTARY COMPRESSOR

(71) Applicant: FUJITSU GENERAL LIMITED, Kanagawa (JP)

(72) Inventors: Kenshi Ueda, Kanagawa (JP); Yasuyuki Izumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 91 days.

(21) Appl. No.: 16/633,049

(22) PCT Filed: Jul. 20, 2018

(86) PCT No.: PCT/JP2018/027394
§ 371 (c)(1),
(2) Date: Jan. 22, 2020

(87) PCT Pub. No.: WO2019/021976
PCT Pub. Date: Jan. 31, 2019

(65) Prior Publication Data

US 2020/0208634 A1 Jul. 2, 2020

(30) Foreign Application Priority Data

Jul. 24, 2017 (JP) ..... JP2017-143068

(51) Int. Cl.
*F04C 23/00* (2006.01)
*F04C 29/12* (2006.01)
*F04C 18/356* (2006.01)

(52) U.S. Cl.
CPC ..... *F04C 23/008* (2013.01); *F04C 18/3564* (2013.01); *F04C 29/128* (2013.01);
(Continued)

(58) Field of Classification Search
CPC .. F04C 18/3564; F04C 23/001; F04C 23/008; F04C 29/0035; F04C 29/0085;
(Continued)

(56) References Cited

U.S. PATENT DOCUMENTS

2011/0058970 A1* 3/2011 Hugenroth ..... F04C 23/001 418/13
2011/0243778 A1* 10/2011 Tanaka ..... F04C 18/3564 418/63

(Continued)

FOREIGN PATENT DOCUMENTS

CN 1712726 A 12/2005
CN 204140397 U 2/2015

(Continued)

OTHER PUBLICATIONS

Mar. 22, 2021, Chinese Office Action issued for related CN application No. 201880049213.X.

*Primary Examiner* — Audrey B. Walter
*Assistant Examiner* — Dapinder Singh
(74) *Attorney, Agent, or Firm* — Paratus Law Group, PLLC

(57) ABSTRACT

In a rotary compressor, a lower end plate includes a lower discharge valve that opens and closes a lower discharge hole, a lower discharge-valve accommodating recessed portion in which the lower discharge valve is accommodated, and a lower discharge-chamber recessed portion that is formed so as to overlap with the lower discharge hole side of the lower discharge-valve accommodating recessed portion and communicates with a refrigerant passage hole. A lower end plate cover is formed in a flat-plate shape and is provided with a bulging portion having a portion facing the lower discharge hole. An upper end-plate cover chamber is formed by the lower discharge-valve accommodating recessed portion, the lower discharge-chamber recessed portion, and the bulging
(Continued)

portion. The bulging portion has a volume of 1/18 or greater and 1/9 or less of a total of air volumes of an upper compression chamber and a lower compression chamber.

6 Claims, 13 Drawing Sheets

(52) U.S. Cl.
CPC ..... *F04C 2210/26* (2013.01); *F04C 2240/30* (2013.01); *F04C 2240/40* (2013.01); *F04C 2240/50* (2013.01)

(58) Field of Classification Search
CPC ..... F04C 29/128; F04C 2210/26; F04C 2240/30; F04C 2240/40; F04C 2240/50; F01C 21/0863
See application file for complete search history.

(56) References Cited

U.S. PATENT DOCUMENTS

2012/0260691 A1* 10/2012 Hirayama ..... F04C 18/3564 62/498
2015/0078933 A1* 3/2015 Takashima ..... F04C 18/3564 417/410.3

FOREIGN PATENT DOCUMENTS

| | | | |
|---|---|---|---|
| CN | 105134594 | A | 12/2015 |
| CN | 205370980 | U | 7/2016 |
| EP | 3184822 | A1 | 6/2017 |
| JP | 2006-022766 | A | 1/2006 |
| JP | 2009-002297 | A | 1/2009 |
| JP | 2016-044600 | A | 4/2016 |
| JP | 2016-118142 | A | 6/2016 |
| WO | WO 2016/076064 | A1 | 5/2016 |

* cited by examiner (B-B)

(A-A)

(C-C)

(D-D)

(E-E)

(F-F)

ROTARY COMPRESSOR

CROSS REFERENCE TO PRIOR APPLICATION

This application is a National Stage Patent Application of PCT International Patent Application No. PCT/JP2018/027394 (filed on Jul. 20, 2018) under 35 U.S.C. § 371, which claims priority to Japanese Patent Application No. 2017-143068 (filed on Jul. 24, 2017), which are all hereby incorporated by reference in their entirety.

FIELD

The present invention relates to a rotary compressor.

BACKGROUND

In an air conditioner and a refrigeration apparatus, for example, a two-cylinder rotary compressor is used for compressing a refrigerant. In the two-cylinder rotary compressor, in order to reduce fluctuation in torque per one rotation of a rotating shaft as much as possible, in general, two upper and lower cylinders are configured such that the processes of suction, compression, and discharge are performed in phases different by 180°. Except for peculiar operation conditions such as at the time of start-up, in the operation of the air conditioner at normal outdoor temperature and indoor temperature, the discharge process of one cylinder occupies approximately ⅓ in one rotation. Thus, ⅓ in one rotation is the discharge process (the process in which a discharge valve is opened) of one cylinder, another ⅓ is the discharge process of the other cylinder, and the remaining ⅓ is the process, in which both discharge valves are closed.

When both of the two discharge valves of the upper cylinder and the lower cylinder are closed, and there is no flow of refrigerant discharged from compression chambers, both an upper muffler chamber (hereinafter also referred to as an upper end-plate cover chamber) and a lower muffler chamber (hereinafter also referred to as a lower end-plate cover chamber) have the same pressure as that in a compressor housing, which is the outside of the upper muffler chamber. In the discharge process of one of the cylinders, the pressure of the compression chamber that is the uppermost stream of the refrigerant flow is the highest in the compressed high-pressure area, and then the muffler chamber and the inside of the compressor housing outside of the upper muffler chamber are high in this order. Accordingly, immediately after the discharge valve of the upper cylinder is opened, the pressure of the upper muffler chamber is higher than the pressure in the compressor housing outside of the upper muffler chamber and the pressure in the lower muffler chamber. Thus, at the next moment, the flow of refrigerant from the upper muffler chamber into the compressor housing outside of the upper muffler chamber and the flow of refrigerant from the upper muffler chamber to the lower muffle chamber by a backward flow through a refrigerant passage hole arise. As just described, what is called a refrigerant backward flow phenomenon in which a part of the refrigerant that is compressed to high pressure in the upper cylinder and is discharged to the upper muffler chamber flows backward through the refrigerant passage hole and flows into the lower muffler chamber arises.

The flow from the upper muffler chamber into the compressor housing that is the outside of the upper muffler chamber, is the original flow, but the refrigerant that has flowed from the upper muffler chamber to the lower muffler chamber flows into the compressor housing of the outside of the upper muffler chamber through the refrigerant passage hole and the upper muffler chamber again after finishing the discharge process of the upper cylinder. The flow into the compressor housing, is a flow not needed originally, and that results in an energy loss and deteriorates the efficiency of the rotary compressor. Then, if the lower muffler chamber formed to a lower end plate and a lower end-plate cover is made too large, as space for which the refrigerant flows backward from the upper muffler chamber flows into the lower muffler chamber becomes large, the deterioration in the efficiency of the rotary compressor tends to become large.

CITATION LIST

Patent Literature

Patent Literature 1: Japanese Patent Application Laid-open No. 2016-118142

SUMMARY

Technical Problem

Hence, in order to reduce the deterioration in the efficiency of the rotary compressor, techniques to make the lower muffler chamber small, and reduce the deterioration in the efficiency of the rotary compressor, by forming the lower end plate cover in a flat-plate shape, or by forming a bulging portion only on a part of the lower end plate cover, have been known.

However, when the volume of the bulging portion of the lower end plate cover is made too small, as the lower muffler chamber becomes too small, the refrigerant compressed in the lower compression chamber of the lower cylinder, flows early from the lower muffler chamber to the upper muffler chamber through the refrigerant passage hole. Thus, there is a problem in that the pressure pulsation in the lower muffler chamber becomes large, a proper silencing effect by the lower muffler chamber is not obtainable, and the amplitude of vibration generated in the lower end-plate cover increases.

Meanwhile, when the volume of the bulging portion of the lower end plate cover is increased, the pressure pulsation in the lower muffler chamber is reduced, and the increase in the amplitude of vibration generated in the rotary compressor along with the pressure pulsation, is suppressed. However, in this case, as the space into which the refrigerant that has flowed backward from the upper muffler chamber through the refrigerant passage hole to the lower muffler chamber flows, is increased, it leads to the deterioration of the efficiency of the rotary compressor.

Thus, it has been difficult to satisfy both the enhancement in the efficiency of the rotary compressor and the suppression of vibration of the rotary compressor.

The disclosed technology has been made in view of the foregoing, and an object thereof is to provide a rotary compressor capable of enhancing the efficiency and suppressing the vibration.

Solution to Problem

To solve the above problem and attain the object, a rotary compressor disclosed in this application, according to an aspect, includes: a sealed and vertical cylindrical compressor housing provided with a refrigerant discharge portion at an upper portion and a refrigerant suction portion at a lower portion; a compression unit arranged at a lower portion of the compressor housing and configured to compress refrigerant that is sucked from the suction portion and to discharge the refrigerant from the discharge portion; and a motor arranged at an upper portion of the compressor housing and configured to drive the compression unit, wherein the compression unit includes an annular upper cylinder and an annular lower cylinder, an upper end plate closing an upper side of the upper cylinder, and a lower end plate closing a lower side of the lower cylinder, an intermediate partition plate arranged between the upper cylinder and the lower cylinder, and closing a lower side of the upper cylinder and an upper side of the lower cylinder, a rotating shaft supported by a main bearing portion provided on the upper end plate and by a sub-bearing portion provided on the lower end plate, and rotated by the motor, an upper eccentric portion and a lower eccentric portion provided on the rotating shaft with a phase difference of 180 degrees from each other, an upper piston fitted in the upper eccentric portion and configured to revolve along an inner peripheral surface of the upper cylinder and form an upper cylinder chamber in the upper cylinder, a lower piston fitted in the lower eccentric portion and configured to revolve along an inner peripheral surface of the lower cylinder and form a lower cylinder chamber in the lower cylinder, an upper vane projecting into the upper cylinder chamber from an upper vane groove provided on the upper cylinder, and brought into contact with the upper piston so as to section the upper cylinder chamber into an upper suction chamber and an upper compression chamber, a lower vane projecting into the lower cylinder chamber from a lower vane groove provided on the lower cylinder, and brought into contact with the lower piston so as to section the lower cylinder chamber into a lower suction chamber and a lower compression chamber, an upper end plate cover covering the upper end plate, forming an upper end-plate cover chamber between the upper end plate and the upper end plate cover, and having an upper end-plate cover discharge hole communicating with the upper end-plate cover chamber and an inside of the compressor housing, a lower end plate cover covering the lower end plate and forming a lower end-plate cover chamber between the lower end plate and the lower end plate cover, an upper discharge hole provided on the upper end plate and communicating with the upper compression chamber and the upper end-plate cover chamber, a lower discharge hole provided on the lower end plate and communicating with the lower compression chamber and the lower end-plate cover chamber, and a refrigerant passage hole running through the lower end plate, the lower cylinder, the intermediate partition plate, the upper end plate, and the upper cylinder, and communicating with the lower end-plate cover chamber and the upper end-plate cover chamber, the lower end plate includes a lower discharge valve of a reed valve type configured to open and close the lower discharge hole, a lower discharge-valve accommodating recessed portion that extends in a groove shape from the lower discharge hole and into which the lower discharge valve is accommodated, and a lower discharge-chamber recessed portion formed so as to overlap with the lower discharge hole side of the lower discharge-valve accommodating recessed portion and communicate with the refrigerant passage hole, the lower end plate cover is formed in a flat-plate shape and is provided with a bulging portion having a portion facing the lower discharge hole, the lower end-plate cover chamber is formed by the lower discharge-valve accommodating recessed portion, the lower discharge-chamber recessed portion, and the bulging portion, and the bulging portion has a volume of 1/18 or greater and 1/9 or less of a total of air volumes of the upper compression chamber and the lower compression chamber.

Advantageous Effects of Invention

According to one aspect of the rotary compressor disclosed in the present application, it is possible to enhance the efficiency of the rotary compressor and to suppress the vibration.

DESCRIPTION OF EMBODIMENT

The following describes in detail an exemplary embodiment of a rotary compressor disclosed in the present application with reference to the accompanying drawings.

The rotary compressor disclosed in the present application, is not limited by the following exemplary embodiment.

EMBODIMENT

Figure 1:
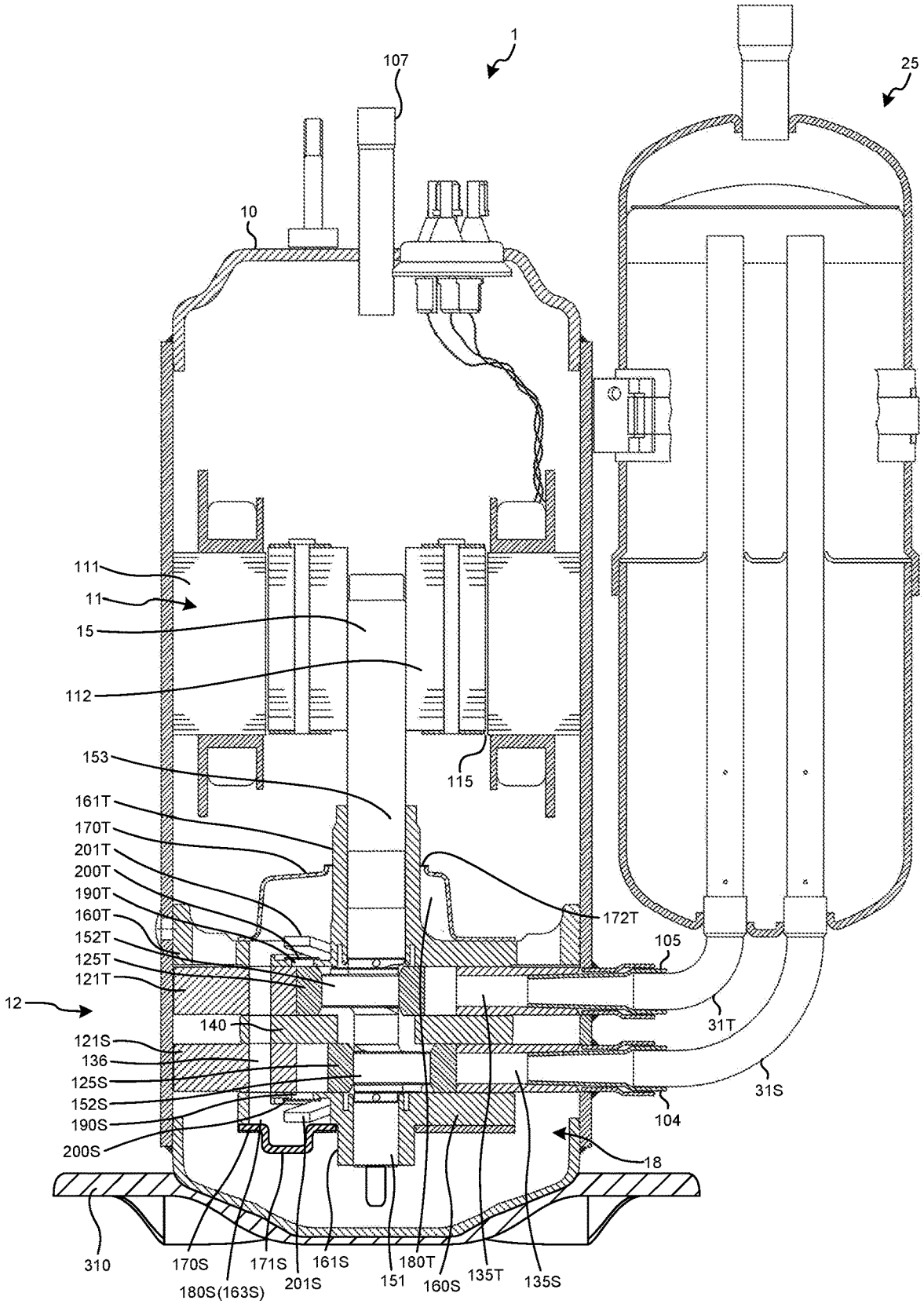
FIG. 1 is a longitudinal sectional view illustrating a rotary compressor of an embodiment.
Figure 2:
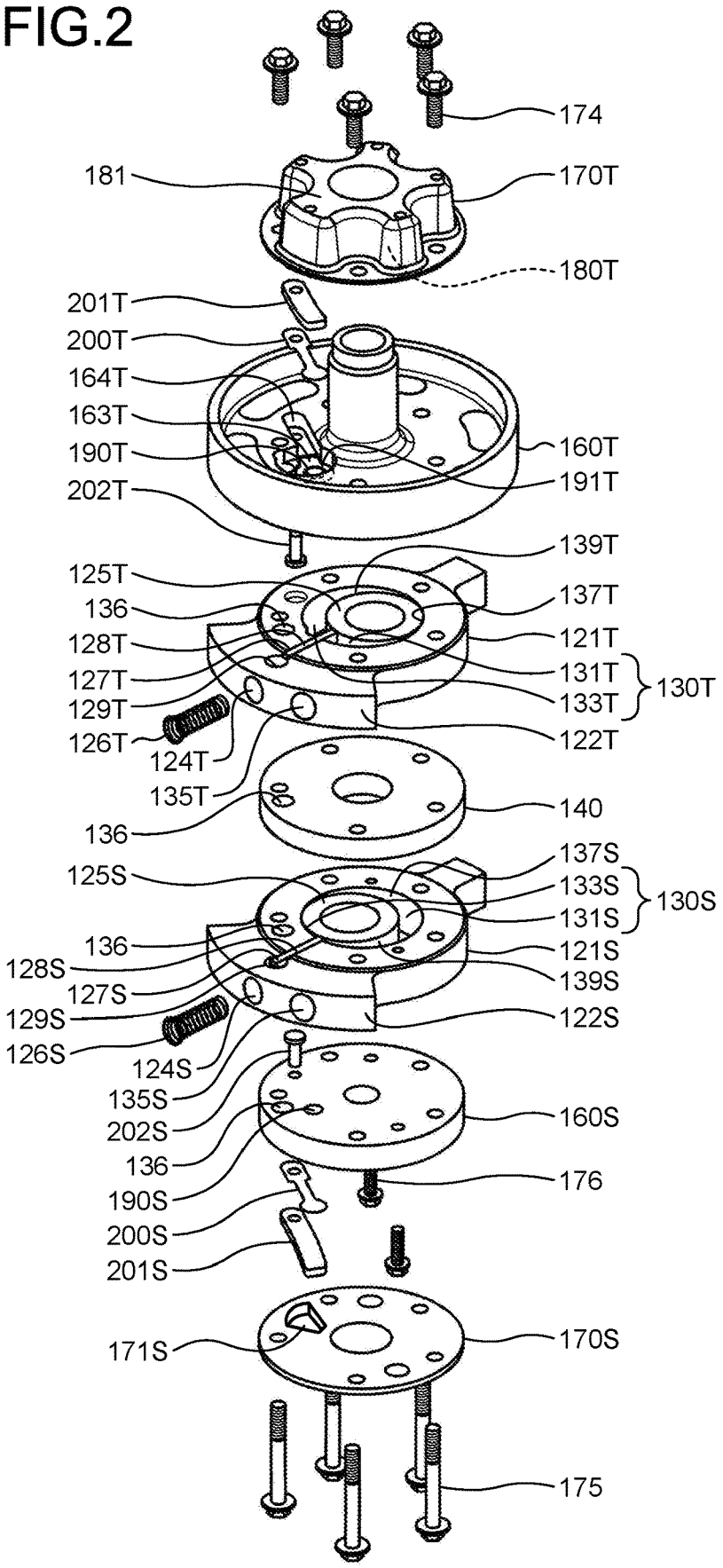
FIG. 2 is an exploded perspective view illustrating a compression unit of the rotary compressor of the embodiment.
Figure 3:
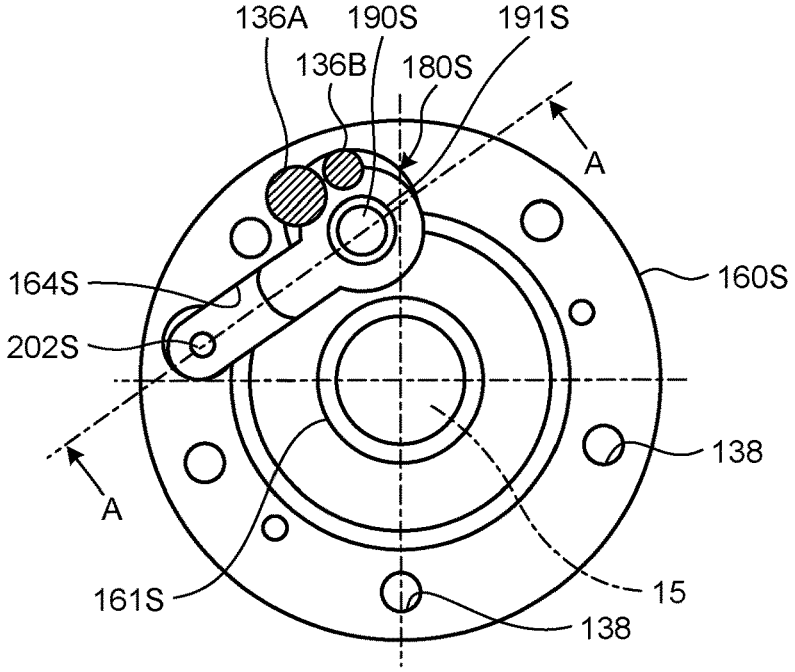
FIG. 3 is a plan view of a lower end plate of the rotary compressor of the embodiment as viewed from below.

Configuration of Rotary Compressor FIG. 1 is a longitudinal sectional view illustrating a rotary compressor of an embodiment. FIG. 2 is an exploded perspective view illustrating a compression unit of the rotary compressor of the embodiment. FIG. 3 is a plan view of a lower end plate of the rotary compressor of the embodiment as viewed from below.

As illustrated in FIG. 1, a rotary compressor 1 includes a compression unit 12 arranged at a lower portion in a sealed and vertical cylindrical compressor housing 10, a motor 11 arranged at an upper portion in the compressor housing 10 and configured to drive the compression unit 12 via a rotating shaft 15, and a sealed and vertical cylindrical accumulator 25 fixed to an outer peripheral surface of the compressor housing 10.

The compressor housing 10 includes an upper suction pipe 105 and a lower suction pipe 104 that suck in a refrigerant, and the upper suction pipe 105 and the lower suction pipe 104 are provided at a lower lateral portion of the compressor housing 10. The accumulator 25 is connected to an upper cylinder chamber 130T (see FIG. 2) of an upper cylinder 121T via the upper suction pipe 105 and an accumulator-upper curved pipe 31T as a suction portion, and is connected to a lower cylinder chamber 130S (see FIG. 2) of a lower cylinder 121S via the lower suction pipe 104 and an accumulator-lower curved pipe 31S as a suction portion. In the present embodiment, in the circumferential direction of the compressor housing 10, the positions of the upper suction pipe 105 and the lower suction pipe 104 overlap and are located at the same position.

The motor 11 includes a stator 111 arranged on the outside and a rotor 112 arranged on the inside. The stator 111 is fixed to the inner peripheral surface of the compressor housing 10 by shrink fitting or welding. The rotor 112 is fixed to the rotating shaft 15 by shrink fitting.

In the rotating shaft 15, a sub-shaft portion 151 below a lower eccentric portion 152S is rotatively supported by a sub-bearing portion 161S provided on a lower end plate 160S, and a main shaft portion 153 above an upper eccentric portion 152T is rotatively supported by a main bearing portion 161T provided on an upper end plate 160T. On the rotating shaft 15, the upper eccentric portion 152T and the lower eccentric portion 152S are provided with a phase difference of 180 degrees from each other, and an upper piston 125T is supported by the upper eccentric portion 152T and a lower piston 125S is supported by the lower eccentric portion 152S. As a result, the rotating shaft 15 is rotatively supported with respect to the entire compression unit 12 and also, by the rotation, makes an outer peripheral surface 139T of the upper piston 125T revolve along an inner peripheral surface 137T of the upper cylinder 121T and makes an outer peripheral surface 139S of the lower piston 125S revolve along an inner peripheral surface 137S of the lower cylinder 121S.

In the inside of the compressor housing 10, lubricating oil 18 is sealed by an amount that substantially immerses the compression unit 12, in order to ensure lubricity of sliding portions such as the upper cylinder 121T and the upper piston 125T, the lower cylinder 121S and the lower piston 125S, and the like sliding in the compression unit 12 and to seal an upper compression chamber 133T (see FIG. 2) and a lower compression chamber 133S (see FIG. 2). On the lower side of the compressor housing 10, fixed is a mounting leg 310 (see FIG. 1) that latches to a plurality of elastic supporting members (not illustrated) that support the entire rotary compressor 1.

As illustrated in FIG. 1, the compression unit 12 compresses the refrigerant sucked in from the upper suction pipe 105 and the lower suction pipe 104, and discharges the refrigerant from a discharge pipe 107 which will be described later. As illustrated in FIG. 2, the compression unit 12 is made up of, from above, stacking an upper end plate cover 170T having a bulging portion 181 in which a hollow space is formed inside, the upper end plate 160T, the annular upper cylinder 121T, an intermediate partition plate 140, the annular lower cylinder 121S, the lower end plate 160S, and a flat plate-shaped lower end plate cover 170S. The entire compression unit 12 is fixed from above and below by a plurality of through bolts 174 and 175 and auxiliary bolts 176 arranged substantially concentrically.

On the upper cylinder 121T, the cylindrical inner peripheral surface 137T is formed. On the inner side of the inner peripheral surface 137T of the upper cylinder 121T, the upper piston 125T having an outer diameter smaller than the inner diameter of the inner peripheral surface 137T of the upper cylinder 121T, is arranged, and between the inner peripheral surface 137T of the upper cylinder 121T and the outer peripheral surface 139T of the upper piston 125T, the upper compression chamber 133T that sucks, compresses, and discharges the refrigerant, is formed. On the lower cylinder 121S, the cylindrical inner peripheral surface 137S is formed. On the inner side of the inner peripheral surface 137S of the lower cylinder 121S, the lower piston 125S having an outer diameter smaller than the inner diameter of the inner peripheral surface 137S of the lower cylinder 121S, is arranged, and between the inner peripheral surface 137S of the lower cylinder 121S and the outer peripheral surface 139S of the lower piston 125S, the lower compression chamber 133S that sucks, compresses, and discharges the refrigerant, is formed.

As illustrated in FIG. 2, the upper cylinder 121T includes an upper lateral projecting portion 122T projecting from the outer peripheral portion toward the outer peripheral side in the radial direction of the cylindrical inner peripheral surface 137T. On the upper lateral projecting portion 122T, an upper vane groove 128T extending radially outward from the upper cylinder chamber 130T, is provided. In the upper vane groove 128T, an upper vane 127T is arranged to be slidable. The lower cylinder 121S includes a lower lateral projecting portion 122S projecting from the outer peripheral portion toward the outer peripheral side in the radial direction of the cylindrical inner peripheral surface 137S. On the lower lateral projecting portion 122S, a lower vane groove 128S extending radially outward from the lower cylinder chamber 130S, is provided. In the lower vane groove 128S, a lower vane 127S is arranged to be slidable.

The upper lateral projecting portion 122T is formed extending over a predetermined projecting range, along the circumferential direction of the inner peripheral surface 137T of the upper cylinder 121T. The lower lateral projecting portion 122S is formed extending over a predetermined projecting range, along the circumferential direction of the inner peripheral surface 137S of the lower cylinder 121S. The upper lateral projecting portion 122T and the lower lateral projecting portion 122S are used as chuck holding portions for fixing to a machining jig when machining the upper cylinder 121T and the lower cylinder 121S. As the upper lateral projecting portion 122T and the lower lateral projecting portion 122S are fixed to the machining jig, the upper cylinder 121T and the lower cylinder 121S are positioned at predetermined positions.

On the upper lateral projecting portion 122T, from the outer lateral surface at the position overlapping the upper vane groove 128T, an upper spring hole 124T is provided at a depth not running through the upper cylinder chamber 130T. At the upper spring hole 124T, an upper spring 126T is arranged. On the lower lateral projecting portion 122S, from the outer lateral surface at the position overlapping the lower vane groove 128S, a lower spring hole 124S is provided at a depth not running through the lower cylinder chamber 130S. At the lower spring hole 124S, a lower spring 126S is arranged.

Furthermore, on the upper cylinder 121T, formed is an upper pressure guiding path 129T that guides the compressed refrigerant in the compressor housing 10 by making the outside in the radial direction of the upper vane groove 128T communicate with the inside of the compressor housing 10 via an opening, and that applies a back pressure to the upper vane 127T by the pressure of the refrigerant. On the lower cylinder 121S, formed is a lower pressure guiding path 129S that guides the compressed refrigerant in the compressor housing 10 by making the outside in the radial direction of the lower vane groove 128S communicate with the inside of the compressor housing 10, and that applies a back pressure to the lower vane 127S by the pressure of the refrigerant.

On the upper lateral projecting portion 122T of the upper cylinder 121T, an upper suction hole 135T to which the upper suction pipe 105 is fitted in, is provided.

On the lower lateral projecting portion 122S of the lower cylinder 121S, a lower suction hole 135S to which the lower suction pipe 104 is fitted in, is provided.

As illustrated in FIG. 2, the upper cylinder chamber 130T is closed by the upper end plate 160T on the upper side and is closed by the intermediate partition plate 140 on the lower side. The lower cylinder chamber 130S is closed by the intermediate partition plate 140 on the upper side and is closed by the lower end plate 160S on the lower side.

The upper cylinder chamber 130T is, as the upper vane 127T is pressed by the upper spring 126T and is brought into contact with the outer peripheral surface 139T of the upper piston 125T, sectioned into an upper suction chamber 131T that communicates with the upper suction hole 135T, and into the upper compression chamber 133T that communicates with an upper discharge hole 190T provided on the upper end plate 160T. The lower cylinder chamber 130S is, as the lower vane 127S is pressed by the lower spring 126S and is brought into contact with the outer peripheral surface 139S of the lower piston 125S, sectioned into a lower suction chamber 131S that communicates with the lower suction hole 135S, and into the lower compression chamber 133S that communicates with a lower discharge hole 190S provided on the lower end plate 160S.

Furthermore, the upper discharge hole 190T is provided in the vicinity of the upper vane groove 128T and the lower discharge hole 190S is provided in the vicinity of the lower vane groove 128S. The refrigerant compressed in the upper compression chamber 133T, is discharged passing through the upper discharge hole 190T from the inside of the upper compression chamber 133T. The refrigerant compressed in the lower compression chamber 133S, is discharged passing through the lower discharge hole 190S from the inside of the lower compression chamber 133S.

As illustrated in FIG. 2, on the upper end plate 160T, the upper discharge hole 190T that passes through the upper end plate 160T and communicates with the upper compression chamber 133T of the upper cylinder 121T, is provided. On the outlet side of the upper discharge hole 190T, an upper valve seat 191T is formed around the upper discharge hole 190T. On the upper side (upper end plate cover 170T side) of the upper end plate 160T, an upper discharge-valve accommodating recessed portion 164T extending in a groove shape toward the outer periphery of the upper end plate 160T from the position of the upper discharge hole 190T, is formed.

In the inside of the upper discharge-valve accommodating recessed portion 164T, an entire upper discharge valve 200T of a reed valve type and an entire upper discharge valve presser 201T that regulates an opening degree of the upper discharge valve 200T, are accommodated. In the upper discharge valve 200T, a base end portion is fixed in the upper discharge-valve accommodating recessed portion 164T with an upper rivet 202T, and a distal end portion opens and closes the upper discharge hole 190T. In the upper discharge valve presser 201T, a base end portion is overlapped with the upper discharge valve 200T and fixed in the upper discharge-valve accommodating recessed portion 164T with the upper rivet 202T, and a distal end portion is curved (warped) toward the direction in which the upper discharge valve 200T is opened, and regulates the opening degree of the upper discharge valve 200T. Furthermore, the upper discharge-valve accommodating recessed portion 164T is formed having a width slightly larger than the widths of the upper discharge valve 200T and the upper discharge valve presser 201T, and accommodates the upper discharge valve 200T and the upper discharge valve presser 201T, and also performs positioning of the upper discharge valve 200T and the upper discharge valve presser 201T.

As illustrated in FIG. 3, on the lower end plate 160S, the lower discharge hole 190S that passes through the lower end plate 160S and communicates with the lower compression chamber 133S of the lower cylinder 121S, is provided. On the outlet side of the lower discharge hole 190S, an annular lower valve seat 191S is formed around the lower discharge hole 190S. The lower valve seat 191S is formed so as to be raised with respect to the bottom surface of a lower discharge-chamber recessed portion 163S which will be described later. On the lower side (lower end plate cover 170S side) of the lower end plate 160S, a lower discharge-valve accommodating recessed portion 164S extending in a groove shape toward the outer periphery of the lower end plate 160S from the position of the lower discharge hole 190S, is formed.

In the inside of the lower discharge-valve accommodating recessed portion 164S, an entire lower discharge valve 200S of a reed valve type and an entire lower discharge valve presser 201S that regulates an opening degree of the lower discharge valve 200S, are accommodated. In the lower discharge valve 200S, a base end portion is fixed in the lower discharge-valve accommodating recessed portion 164S with a lower rivet 202S, and a distal end portion opens and closes the lower discharge hole 190S. In the lower discharge valve presser 201S, a base end portion is overlapped with the lower discharge valve 200S and fixed in the lower discharge-valve accommodating recessed portion 164S with the lower rivet 202S, and a distal end portion is curved (warped) toward the direction in which the lower discharge valve 200S is opened, and regulates the opening degree of the lower discharge valve 200S. Furthermore, the lower discharge-valve accommodating recessed portion 164S is formed having a width slightly larger than the widths of the lower discharge valve 200S and the lower discharge valve presser 201S, and accommodates the lower discharge valve 200S and the lower discharge valve presser 201S, and also performs positioning of the lower discharge valve 200S and the lower discharge valve presser 201S.

In addition, between the upper end plate 160T and the upper end plate cover 170T having the bulging portion 181 that are closely fixed to each other, an upper end-plate cover chamber 180T is formed. Between the lower end plate 160S and the flat-plate shape lower end plate cover 170S that are closely fixed to each other, a lower end-plate cover chamber 180S (see FIG. 3) is formed. As refrigerant communicating holes that run through the lower end plate 160S, the lower cylinder 121S, the intermediate partition plate 140, the upper end plate 160T, and the upper cylinder 121T and that communicate with the lower end-plate cover chamber 180S and the upper end-plate cover chamber 180T, two refrigerant passage holes 136A and 136B (shaded portions in FIG. 3) are provided.

As illustrated in FIG. 3, the refrigerant passage holes 136A and 136B are formed in a circular shape, and are arranged adjacent to each other along the outer peripheral surface of the lower end plate 160S. The refrigerant passage hole 136A is formed having a diameter larger than that of the refrigerant passage hole 136B, and is arranged on the base end portion side (lower rivet 202S side) of the lower discharge valve 200S relative to the refrigerant passage hole 136B. The refrigerant passage hole 136A is arranged so as to overlap with at least a part of the inner peripheral surface of the lower discharge-chamber recessed portion 163S. The refrigerant passage hole 136B is arranged in the lower discharge-chamber recessed portion 163S in contact with the inner peripheral surface of the lower discharge-chamber recessed portion 163S. In the present embodiment, the two refrigerant passage holes 136A and 136B are provided, but the number of the refrigerant passage holes is not limited to two.

As illustrated in FIG. 3, the lower discharge-chamber recessed portion 163S communicates with the lower discharge-valve accommodating recessed portion 164S. The lower discharge-chamber recessed portion 163S is formed to the same depth as the depth of the lower discharge-valve accommodating recessed portion 164S so as to overlap with the lower discharge hole 190S side of the lower discharge-valve accommodating recessed portion 164S. The lower discharge hole 190S side of the lower discharge-valve accommodating recessed portion 164S is accommodated in the lower discharge-chamber recessed portion 163S. The refrigerant passage holes 136A and 136B overlap with at least a part of the lower discharge-chamber recessed portion 163S and are arranged at positions communicating with the lower discharge-chamber recessed portion 163S.

On the lower surface of the lower end plate 160S (contact surface with the lower end plate cover 170S), in an area other than the area where the lower discharge-chamber recessed portion 163S and the lower discharge-valve accommodating recessed portion 164S are formed, a plurality of bolt holes 138 (FIG. 3) to which the through bolts 174 and the like are inserted, is provided.

Refrigerant passage holes 136A and 136B are arranged at positions overlapping with at least a part of an upper discharge-chamber recessed portion 163T and communicating with the upper discharge-chamber recessed portion 163T. As for the upper discharge-chamber recessed portion 163T and the upper discharge-valve accommodating recessed portion 164T formed on the upper end plate 160T, although detailed depiction is omitted, they are formed in the same shapes as those of the lower discharge-chamber recessed portion 163S and the lower discharge-valve accommodating recessed portion 164S that are formed on the lower end plate 160S. The upper end-plate cover chamber 180T is formed by the dome-shaped bulging portion 181 of the upper end plate cover 170T, the upper discharge-chamber recessed portion 163T, and the upper discharge-valve accommodating recessed portion 164T.

The following describes the flow of refrigerant by the rotation of the rotating shaft 15. In the upper cylinder chamber 130T, by the rotation of the rotating shaft 15, as the upper piston 125T fitted to the upper eccentric portion 152T of the rotating shaft 15 revolves along the inner peripheral surface 137T of the upper cylinder 121T, the upper suction chamber 131T sucks the refrigerant from the upper suction pipe 105 while expanding the volume, the upper compression chamber 133T compresses the refrigerant while reducing the volume, and when the pressure of the compressed refrigerant becomes higher than the pressure of the upper end-plate cover chamber 180T outside of the upper discharge valve 200T, the upper discharge valve 200T is opened, and the refrigerant is discharged from the upper compression chamber 133T to the upper end-plate cover chamber 180T. The refrigerant discharged to the upper end-plate cover chamber 180T, is discharged into the compressor housing 10 from an upper end-plate cover discharge hole 172T (see FIG. 1) provided on the upper end plate cover 170T.

Furthermore, in the lower cylinder chamber 130S, by the rotation of the rotating shaft 15, as the lower piston 125S fitted to the lower eccentric portion 152S of the rotating shaft 15, revolves along the inner peripheral surface 137S of the lower cylinder 121S, the lower suction chamber 131S sucks the refrigerant from the lower suction pipe 104 while expanding the volume, the lower compression chamber 133S compresses the refrigerant while reducing the volume, and when the pressure of the compressed refrigerant becomes higher than the pressure of the lower end-plate cover chamber 180S outside of the lower discharge valve 200S, the lower discharge valve 200S is opened, and the refrigerant is discharged from the lower compression chamber 133S to the lower end-plate cover chamber 180S. The refrigerant discharged to the lower end-plate cover chamber 180S, passes through the refrigerant passage holes 136A and 136B and the upper end-plate cover chamber 180T, and is discharged into the compressor housing 10 from the upper end-plate cover discharge hole 172T provided on the upper end plate cover 170T.

The refrigerant discharged into the compressor housing 10, is guided to the upper side of the motor 11 through a cutout (not illustrated) provided on the outer periphery of the stator 111 and communicating with the upper and lower portions, a gap (not illustrated) in a winding portion of the stator 111, or a gap 115 (see FIG. 1) between the stator 111 and the rotor 112, and is discharged from the discharge pipe 107 as a discharge portion arranged on the upper portion of the compressor housing 10.

Characteristic Configuration of Rotary Compressor

Figure 4:
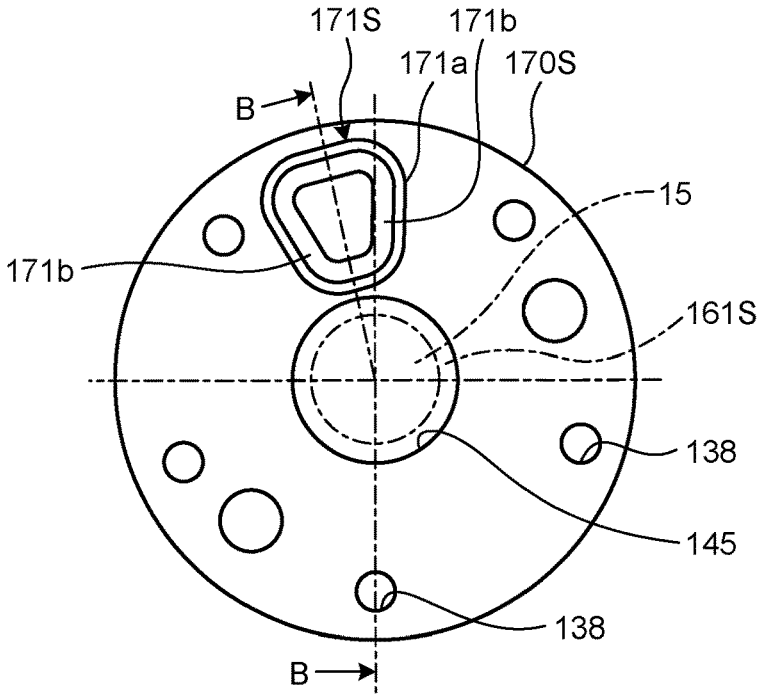
FIG. 4 is a plan view of a lower end plate cover of the rotary compressor of the embodiment as viewed from above.
Figure 5:
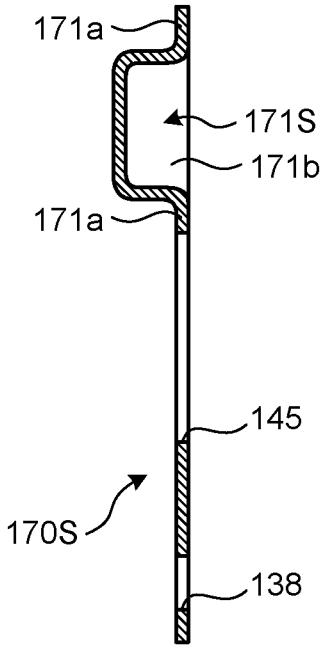
FIG. 5 is a cross-sectional view illustrating the lower end plate cover of the rotary compressor of the embodiment viewed along the B-B line in FIG. 4.
Figure 6:
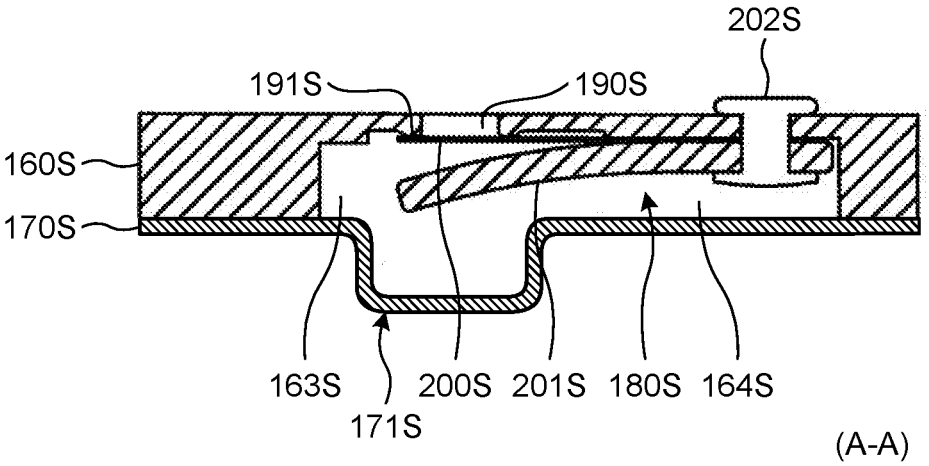
FIG. 6 is a cross-sectional view illustrating a principal portion of the rotary compressor of the embodiment viewed along the A-A line in FIG. 3.
Figure 7:
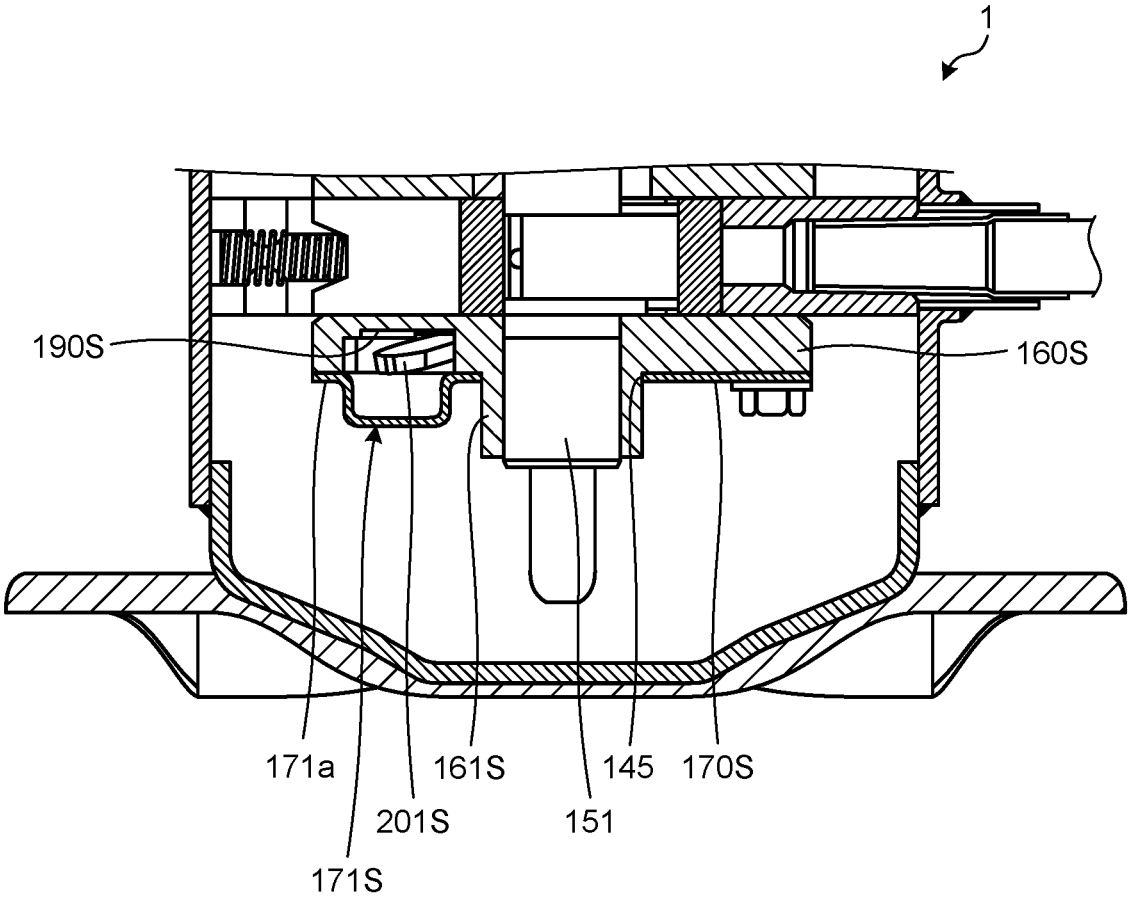
FIG. 7 is a longitudinal sectional view illustrating a principal portion of the rotary compressor of the embodiment.

Next, a characteristic configuration of the rotary compressor 1 of the embodiment, will be described. In the present embodiment, the volume of a bulging portion 171S of the lower end plate cover 170S is a feature. FIG. 4 is a plan view of the lower end plate cover 170S of the rotary compressor 1 of the embodiment as viewed from above. FIG. 5 is a cross-sectional view illustrating the lower end plate cover 170S of the rotary compressor 1 of the embodiment viewed along the B-B line in FIG. 4. FIG. 6 is a cross-sectional view illustrating a principal portion of the rotary compressor 1 of the embodiment viewed along the A-A line in FIG. 3. FIG. 7 is a longitudinal sectional view illustrating a principal portion of the rotary compressor 1 of the embodiment.

As illustrated in FIG. 4 and FIG. 5, the lower end plate cover 170S is formed in a flat-plate shape and includes the bulging portion 171S that bulges downward of the rotary compressor 1. The bulging portion 171S forms the lower end-plate cover chamber 180S. Thus, as illustrated in FIG. 6, the lower end-plate cover chamber 180S is formed by the lower discharge-chamber recessed portion 163S and the lower discharge-valve accommodating recessed portion 164S provided on the lower end plate 160S and by the bulging portion 171S of the lower end plate cover 170S.

The bulging portion 171S of the lower end plate cover 170S is provided at a position facing the distal end portion of the lower discharge valve presser 201S (position facing the lower discharge hole 190S). In other words, the bulging portion 171S has a portion (bottom portion) facing the lower discharge hole 190S and overlaps with at least a part of the lower discharge hole 190S in a cross-section orthogonal to the shaft direction of the rotating shaft 15. Furthermore, in the bulging portion 171S, in the thickness direction of the lower end plate 160S, a portion of the distal end portion of the lower discharge valve presser 201S projecting toward the lower end plate cover 170S side from the lower discharge-chamber recessed portion 163S, may be accommodated.

As illustrated in FIG. 4 and FIG. 5, in the middle of the lower end plate cover 170S, a circular through hole 145, into which the sub-shaft portion 151 is inserted, is formed. Furthermore, on the lower end plate cover 170S, in an area that is other than the bulging portion 171S and is other than the area facing the lower discharge-chamber recessed portion 163S and the lower discharge-valve accommodating recessed portion 164S of the lower end plate 160S, a plurality of bolt holes 138 (FIG. 4) through which the through bolts 174 and the like penetrate, is provided.

As illustrated in FIG. 7, the bulging portion 171S of the lower end plate cover 170S is brought into contact with the lower surface of the lower end plate 160S over the entire peripheral edge portion 171*a* of the bulging portion 171S. As a result, because the bulging portion 171S has no portion extending over the sub-bearing portion 161S, the refrigerant is prevented from leaking from the lower end-plate cover chamber 180S, due to variations in the shape of the bulging portion 171S and the shape of the sub-bearing portion 161S, and the airtightness in the bulging portion 171S is enhanced.

Furthermore, as illustrated in FIG. 3 and FIG. 4, the bulging portion 171S has a pair of opposing sidewalls 171*b*, and the interval that the pair of sidewalls 171*b* faces each other is, in the radial direction of the rotating shaft 15, expanded toward the outer peripheral side from the inner peripheral side of the lower end plate cover 170S. As a result, the refrigerant discharged from the lower discharge hole 190S and the refrigerant in the bulging portion 171S, can be made to flow easily toward the refrigerant passage holes 136A and 136B side arranged on the outer peripheral side of the lower end plate 160S along the pair of sidewalls 171*b* of the bulging portion 171S and, as appropriate, the flow of the refrigerant in the lower end-plate cover chamber 180S, can be adjusted as needed.

Volume of Bulging Portion of Lower End Plate Cover

Figure 8:
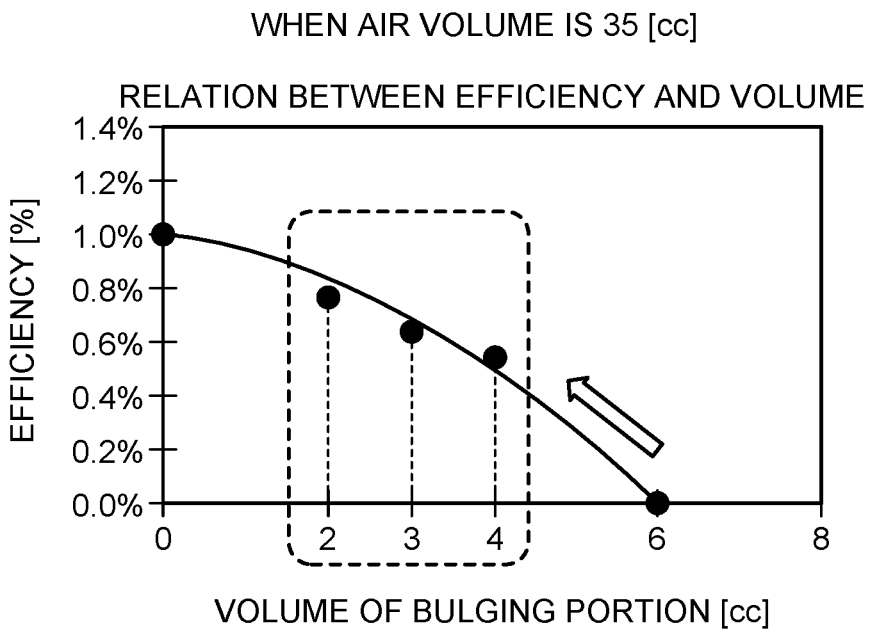
FIG. 8 is a chart illustrating, in a case where an air volume is 35 cc, the relation between efficiency and a volume of a bulging portion, in the rotary compressor of the embodiment.
Figure 9:
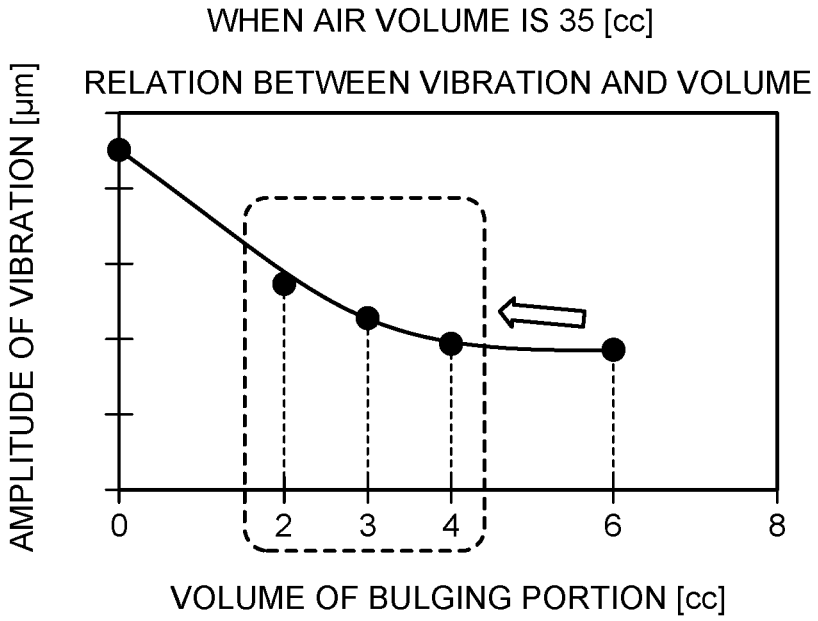
FIG. 9 is a chart illustrating, in a case where the air volume is 35 cc, the relation between vibration and the volume of the bulging portion, in the rotary compressor of the embodiment.
Figure 10:
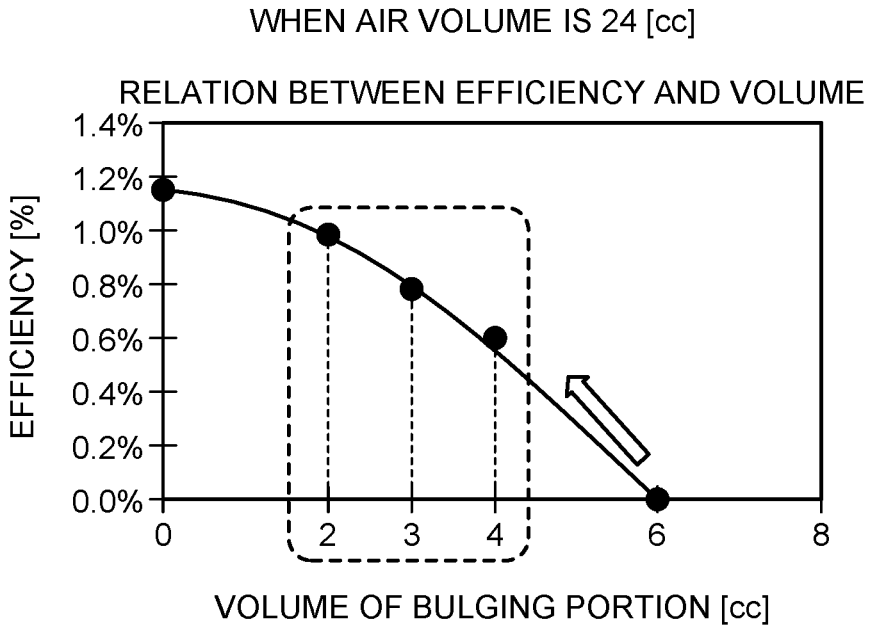
FIG. 10 is a chart illustrating, in a case where the air volume is 24 cc, the relation between efficiency and the volume of the bulging portion, in the rotary compressor of the embodiment.
Figure 11:
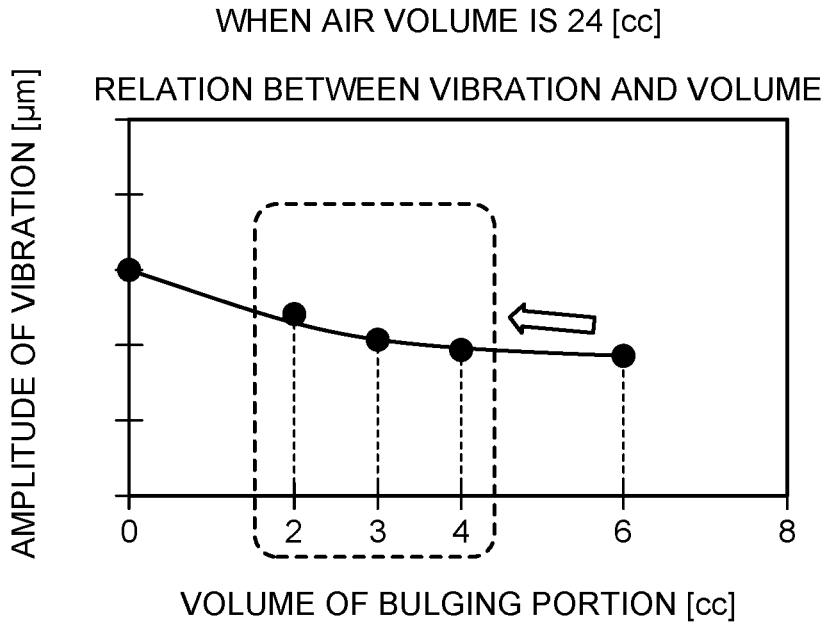
FIG. 11 is a chart illustrating, in a case where the air volume is 24 cc, the relation between vibration and the volume of the bulging portion, in the rotary compressor of the embodiment.

FIG. 8 is a chart illustrating, in a case where an air volume is 35 cc, the relation between the efficiency of the rotary compressor 1 and the volume of the bulging portion 171S, in the rotary compressor 1 of the embodiment. FIG. 9 is a chart illustrating, in a case where the air volume is 35 cc, the relation between vibration and the volume of the bulging portion 171S, in the rotary compressor 1 of the embodiment. FIG. 10 is a chart illustrating, in a case where the air volume is 24 cc, the relation between efficiency and the volume of the bulging portion 171S, in the rotary compressor 1 of the embodiment. FIG. 11 is a chart illustrating, in a case where the air volume is 24 cc, the relation between vibration and the volume of the bulging portion 171S, in the rotary compressor 1 of the embodiment. In FIG. 8 and FIG. 10, the ordinate axis indicates the efficiency (%) of the rotary compressor 1 and the abscissa axis indicates the volume (cc) of the bulging portion 171S. In FIG. 9 and FIG. 11, the ordinate axis indicates the amplitude (μm) of vibration generated in the lower end plate cover 170S and one scale on the ordinate axis is equivalent to 10 (μm). The abscissa axis in FIG. 9 and FIG. 11 indicates the volume (cc) of the bulging portion 171S. In this case, the air volume refers to an air volume in a total of the air volume of the upper compression chamber 133T of the upper cylinder 121T and the air volume of the lower compression chamber 133S of the lower cylinder 121S. The amplitude of vibration is the amplitude with respect to the tangential direction of the outer peripheral surface of the lower portion of the compressor housing 10.

As illustrated in FIG. 8 and FIG. 9, in the case where the air volume of the compression unit 12 is 35 (cc), when the volume of the bulging portion 171S is within a range of 2 or greater and 4 or less (cc), it is possible to enhance the efficiency of the rotary compressor 1 and to reduce the amplitude of vibration generated in the lower end plate cover 170S. Within this range, it is preferable that the volume of the bulging portion 171S be 3 (cc). Thus, when the air volume of 35 (cc) as a reference is assumed, by setting the volume of the bulging portion 171S to within the range of 1/18 or greater and 1/9 or less of the total of the air volumes of the upper compression chamber 133T and the lower compression chamber 133S, it is possible to appropriately satisfy both the enhancement of the efficiency of the rotary compressor 1 and the suppression of vibration generated in the lower end plate cover 170S.

Furthermore, as illustrated in FIG. 10 and FIG. 11, as with the case where the air volume of the compression unit 12 is 35 (cc), in the case where the air volume is 24 (cc), when the volume of the bulging portion 171S is within a range of 2 or greater and 4 or less (cc), it is possible to enhance the efficiency of the rotary compressor 1 and to reduce the amplitude of vibration generated in the lower end plate cover 170S. Within this range, it is preferable that the volume of the bulging portion 171S be 3 (cc). Thus, when the air volume of 24 (cc) as a reference is assumed, by setting the volume of the bulging portion 171S to within the range of 1/12 or greater and 1/6 or less of the total air volume of the air volumes of the upper compression chamber 133T and the lower compression chamber 133S, it is possible to appropriately satisfy both the enhancement of the efficiency of the rotary compressor 1 and the suppression of vibration generated in the lower end plate cover 170S.

Incidentally, the efficiency of the rotary compressor 1 and the pressure pulsation in the lower end-plate cover chamber 180S depend on also the volumes of the lower discharge-valve accommodating recessed portion 164S and the lower discharge-chamber recessed portion 163S that form the lower end-plate cover chamber 180S, in addition to the above-described volume of the bulging portion 171S. However, because an increase in the amplitude of vibration generated in the rotary compressor 1, is not caused when the volume of the lower discharge-valve accommodating recessed portion 164S and the lower discharge-chamber recessed portion 163S is large, there is no need to provide the bulging portion 171S on the lower end plate cover 170S. Meanwhile, when the volume of the lower discharge-valve accommodating recessed portion 164S and the lower discharge-chamber recessed portion 163S is small as with the present embodiment, the amplitude may increase by the air volume, that is, a discharge flow rate of the refrigerant discharged from the lower discharge hole 190S. In the present embodiment, as the volume of the lower discharge-valve accommodating recessed portion 164S and the lower discharge-chamber recessed portion 163S is in a size enough (bare minimum) to ensure the space in which the lower discharge valve 200S and the lower discharge valve presser 201S are accommodated for reasons such as ensuring an appropriate mechanical strength of the lower end plate 160S, the volume of the lower discharge-valve accommodating recessed portion 164S and the lower discharge-chamber recessed portion 163S is kept small. Thus, the present embodiment ensures the volume of the lower end-plate cover chamber 180S by increasing the volume of the bulging portion 171S of the lower end plate cover 170S.

Then, in the present embodiment, in the case of the rotary compressor 1 with the air volume of 35 (cc), by setting the volume of the bulging portion 171S so as to be in a range of 1/18 or greater and 1/9 or less of the air volume, the enhancement of the efficiency of the rotary compressor 1 and the suppression of vibration are both satisfied.

In other words, when the air volume is 35 (cc), by setting the volume of the bulging portion 171S of the lower end plate cover 170S to about 1.9 to about 3.9 (cc), the enhancement of the efficiency of the rotary compressor 1 and the suppression of vibration can be both satisfied.

Note that the air volume of the rotary compressor 1 for which the volume of the bulging portion 171S is formed within the range of 1/18 or greater and 1/9 or less of the air volume, is not limited to 35 (cc). The volume of the bulging portion 171S is, for example, set to about 1.6 to about 3.3 (cc) when the air volume is 30 (cc), and is set to about 1.3 to about 2.7 (cc) when the air volume is 24 (cc), thereby satisfying both the enhancement of the efficiency and the suppression of vibration.

As in the foregoing, the lower end plate cover 170S in the rotary compressor 1 of the embodiment is provided with the bulging portion 171S having a portion facing the lower discharge hole 190S, and the volume of the bulging portion 171S forming the lower end-plate cover chamber 180S is 1/18 or greater and 1/9 or less of the total of air volume of the upper compression chamber 133T and the lower compression chamber 133S. As a result, because the volume of the bulging portion 171S is optimized and the pressure pulsation is suppressed, it is possible to enhance the efficiency of the rotary compressor 1 and also to suppress the vibration of the rotary compressor 1. Thus, the enhancement in energy consumption efficiency (coefficient of performance (COP)) in the refrigeration cycle using the rotary compressor 1 and the suppression of vibration of the rotary compressor 1 can be both satisfied appropriately.

Furthermore, the bulging portion 171S of the lower end plate cover 170S in the rotary compressor 1 of the embodiment is in contact with the lower surface of the lower end plate 160S over the entire peripheral edge portion 171*a* of the bulging portion 171S. As a result, because the bulging portion 171S has no portion extending over the sub-bearing portion 161S, the refrigerant can be prevented from leaking from the lower end-plate cover chamber 180S due to variations in the shape of the bulging portion 171S and the shape of the sub-bearing portion 161S, and the airtightness in the bulging portion 171S can be enhanced.

The following describes first to fourth modifications with reference to the accompanying drawings. In the first to the fourth modifications, the constituent members identical to the embodiment are denoted by the reference signs identical to the embodiment and the description is omitted. In the first to the fourth modifications, the shape of a bulging portion of a lower end plate cover is different from that of the lower end plate cover 170S in the embodiment.

First Modification

Figure 12:
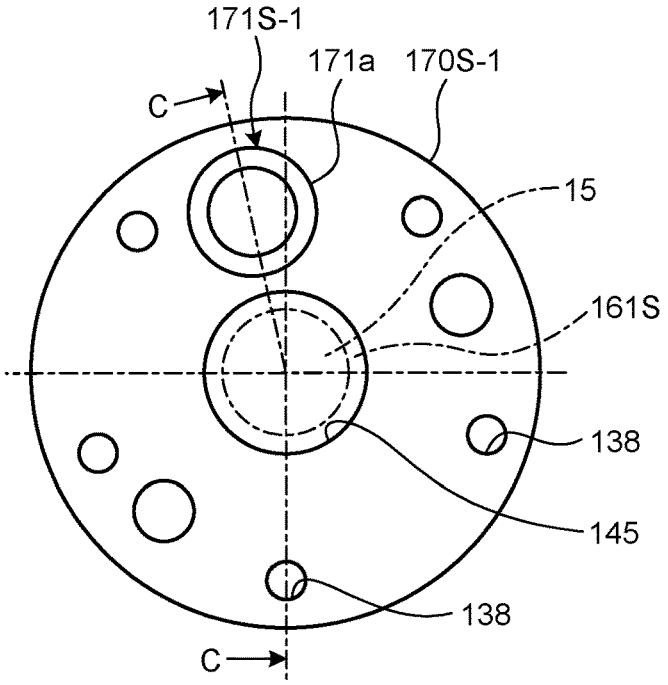
FIG. 12 is a plan view of a lower end plate cover in a rotary compressor of a first modification as viewed from above.
Figure 13:
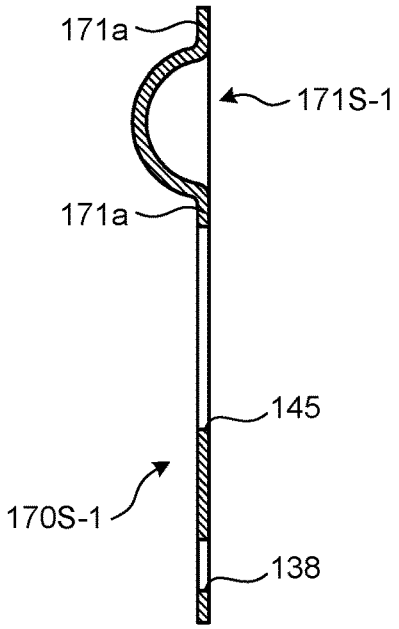
FIG. 13 is a cross-sectional view illustrating the lower end plate cover in the rotary compressor of the first modification viewed along the C-C line in FIG. 12.
Figure 14:
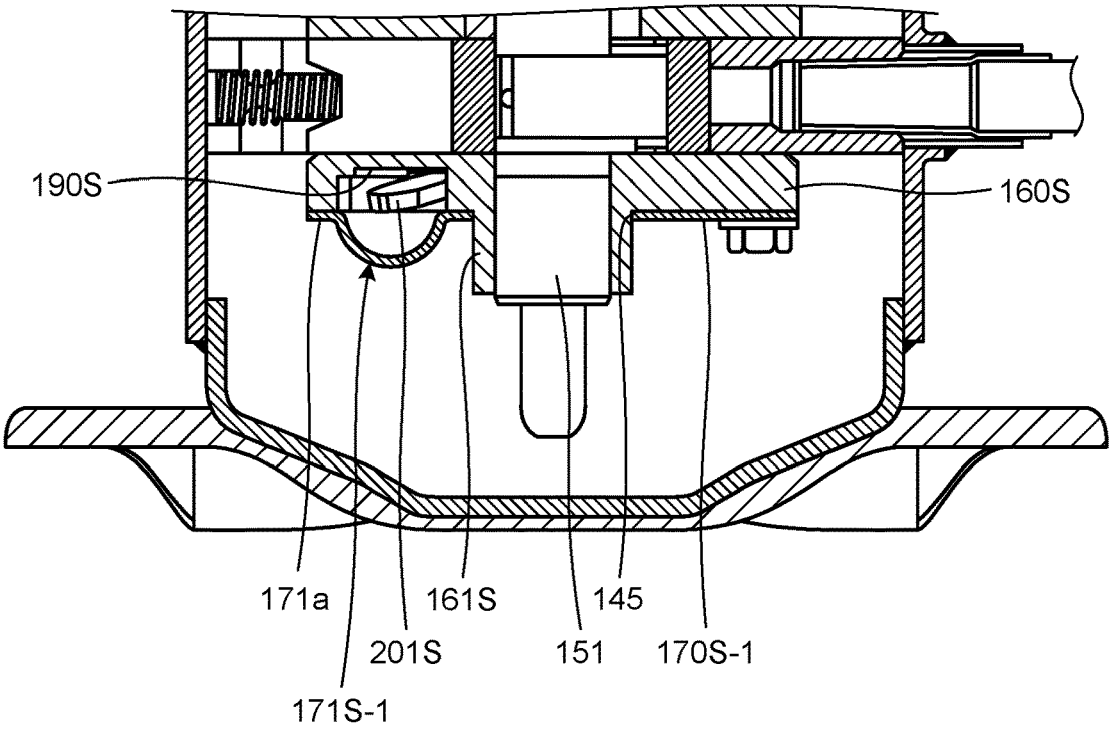
FIG. 14 is a longitudinal sectional view illustrating a principal portion of the rotary compressor of the first modification.

FIG. 12 is a plan view of a lower end plate cover in a rotary compressor of the first modification as viewed from above. FIG. 13 is a cross-sectional view illustrating the lower end plate cover in the rotary compressor of the first modification viewed along the C-C line in FIG. 12. FIG. 14 is a longitudinal sectional view illustrating a principal portion of the rotary compressor of the first modification.

As illustrated in FIG. 12 and FIG. 13, a bulging portion 171S-1 included in a lower end plate cover 170S-1 in the first modification is formed in a hemispherical shape having a portion facing the lower discharge hole 190S. As illustrated in FIG. 14, the bulging portion 171S-1 of the lower end plate cover 170S-1 is in contact with the lower surface of the lower end plate 160S over the entire peripheral edge portion 171*a* of the bulging portion 171S-1. As a result, the airtightness in the bulging portion 171S-1 is enhanced.

Furthermore, as illustrated in FIG. 12 and FIG. 13, as the bulging portion 171S-1 has an inner surface of a hemispherical shape, the refrigerant discharged from the lower discharge hole 190S and the refrigerant in the bulging portion 171S-1 can be made to flow easily into the lower discharge-chamber recessed portion 163S along the inner surface of the bulging portion 171S-1 and, as appropriate, the flow of the refrigerant in the lower end-plate cover chamber 180S can be adjusted as needed.

In the first modification also, because the same effect as that in the embodiment can be obtained and the shape of the bulging portion 171S-1 can be simplified as compared with the embodiment, the workability of the bulging portion 171S-1 in press work can be improved.

Second Modification

Figure 15:
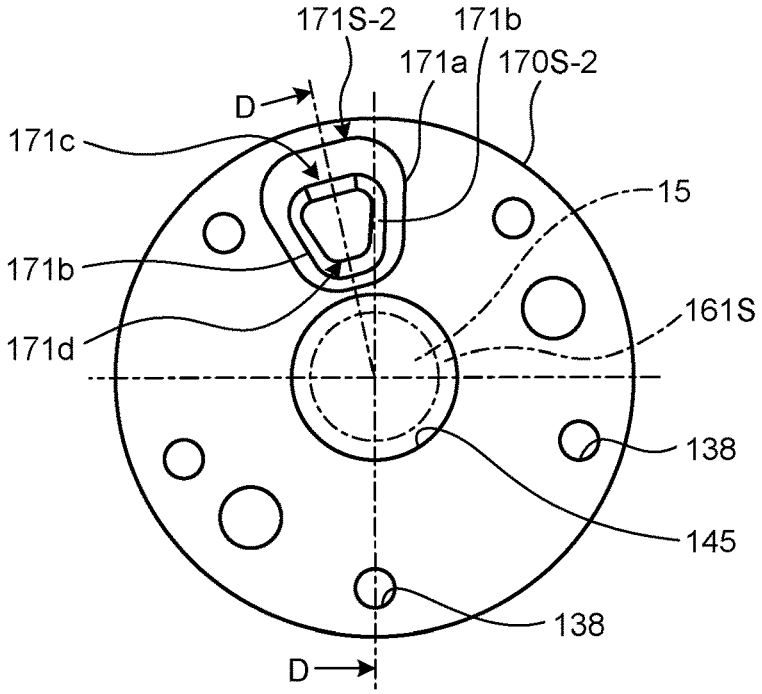
FIG. 15 is a plan view of a lower end plate cover in a rotary compressor of a second modification as viewed from above.
Figure 16:
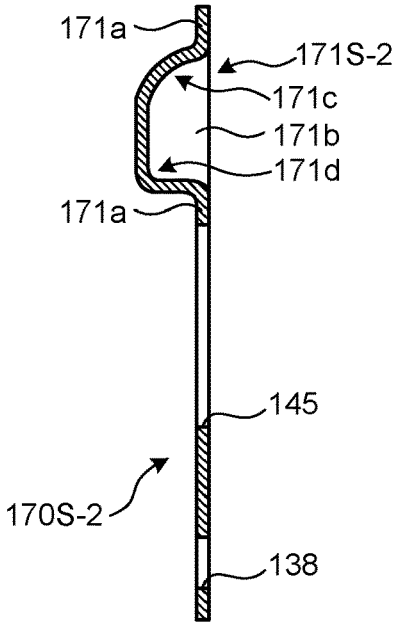
FIG. 16 is a cross-sectional view illustrating the lower end plate cover in the rotary compressor of the second modification viewed along the D-D line in FIG. 15.
Figure 17:
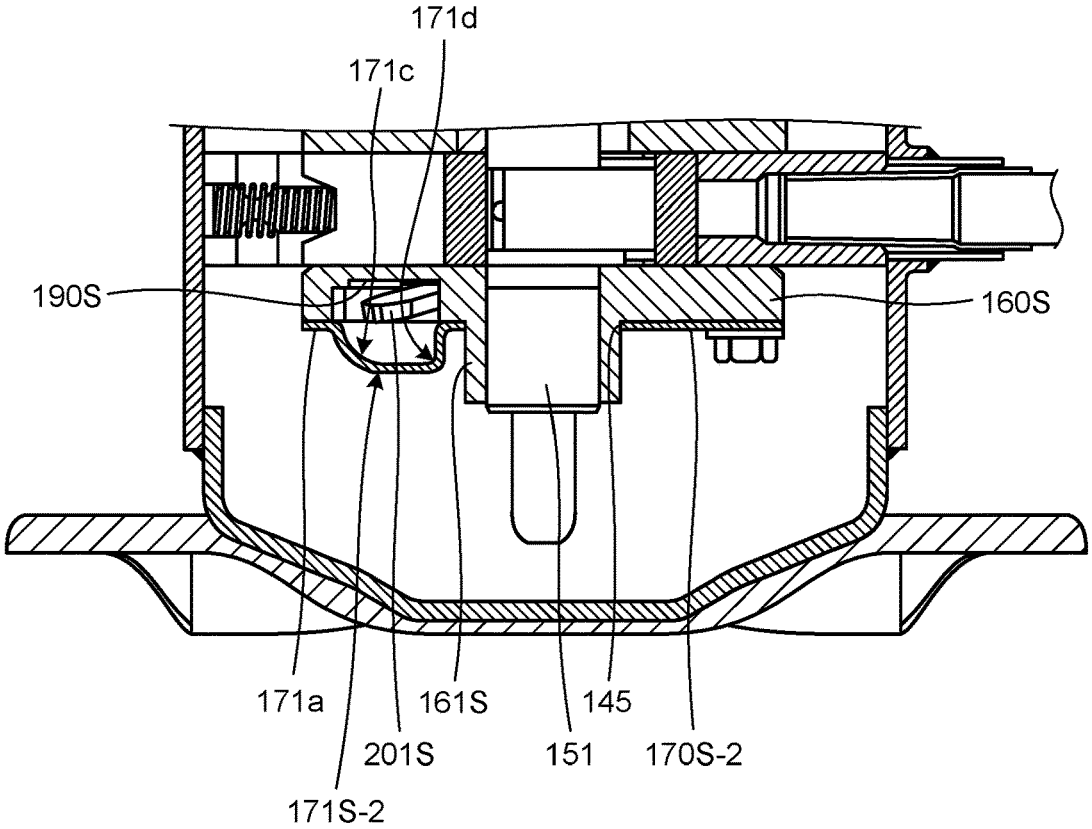
FIG. 17 is a longitudinal sectional view illustrating a principal portion of the rotary compressor of the second modification.

FIG. 15 is a plan view of a lower end plate cover in a rotary compressor of the second modification as viewed from above. FIG. 16 is a cross-sectional view illustrating the lower end plate cover in the rotary compressor of the second modification viewed along the D-D line in FIG. 15. FIG. 17 is a longitudinal sectional view illustrating a principal portion of the rotary compressor of the second modification.

As illustrated in FIG. 15 and FIG. 16, a bulging portion 171S-2 included in a lower end plate cover 170S-2 in the second modification has a portion facing the lower discharge hole 190S. In the bulging portion 171S-2, in the radial direction of the rotating shaft 15, the curvature of an outer peripheral-side corner portion 171*c* located on the outer peripheral side of the lower end plate cover 170S-2, is greater than the curvature of an inner peripheral-side corner portion 171*d* located on the inner peripheral side of the lower end plate cover 170S-2. Thus, the refrigerant discharged from the lower discharge hole 190S and the refrigerant in the bulging portion 171S-2, can be made to flow easily toward the refrigerant passage holes 136A and 136B side along the inner surface of the outer peripheral-side corner portion 171*c* and, as appropriate, the flow of the refrigerant in the lower end-plate cover chamber 180S can be adjusted as needed.

Furthermore, in the bulging portion 171S-2 also, as with the embodiment, the interval that a pair of sidewalls 171*b* faces each other is, in the radial direction of the rotating shaft 15, expanded toward the outer peripheral side from the inner peripheral side of the lower end plate cover 170S-2. Thus, the refrigerant discharged from the lower discharge hole 190S, can be made to flow easily toward the refrigerant passage holes 136A and 136B side along the pair of sidewalls 171*b* of the bulging portion 171S-2 and, as appropriate, the flow of the refrigerant in the lower end-plate cover chamber 180S can be adjusted as needed.

As illustrated in FIG. 17, the bulging portion 171S-2 of the lower end plate cover 170S-2 is in contact with the lower surface of the lower end plate 160S over the entire peripheral edge portion 171*a* of the bulging portion 171S-2. As a result, the airtightness in the bulging portion 171S-2 is enhanced.

According to the second modification, as the curvature of the outer peripheral-side corner portion 171*c* is greater than the curvature of the inner peripheral-side corner portion 171*d*, the refrigerant in the lower end-plate cover chamber 180S can be made to flow easily to the refrigerant passage holes 136A and 136B along the inner surface of the outer peripheral-side corner portion 171*c*. In the second modification also, the same effect as that in the embodiment can be obtained.

Third Modification

Figure 18:
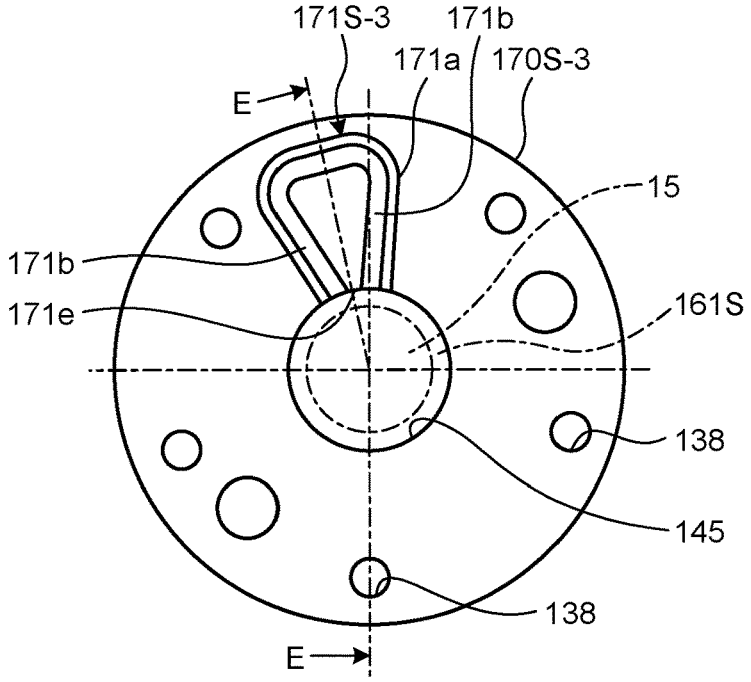
FIG. 18 is a plan view of a lower end plate cover in a rotary compressor of a third modification as viewed from above.
Figure 19:
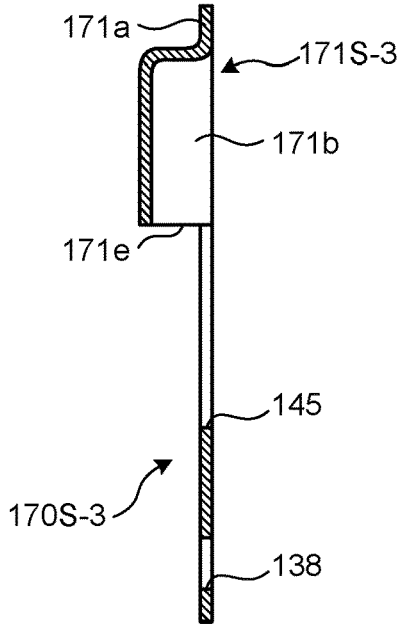
FIG. 19 is a cross-sectional view illustrating the lower end plate cover in the rotary compressor of the third modification viewed along the E-E line in FIG. 18.
Figure 20:
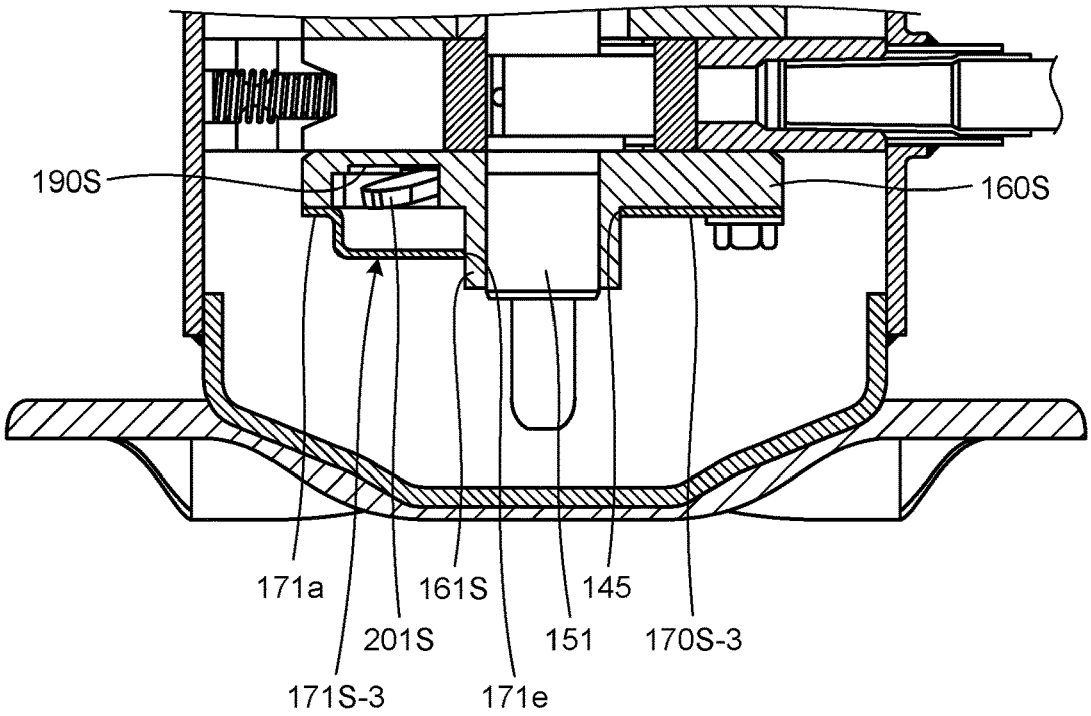
FIG. 20 is a longitudinal sectional view illustrating a principal portion in the rotary compressor of the third modification.

FIG. 18 is a plan view of a lower end plate cover in a rotary compressor of the third modification as viewed from above. FIG. 19 is a cross-sectional view illustrating the lower end plate cover in the rotary compressor of the third modification viewed along the E-E line in FIG. 18. FIG. 20 is a longitudinal sectional view illustrating a principal portion of the rotary compressor of the third modification.

As illustrated in FIG. 18 and FIG. 19, a bulging portion 171S-3 included in a lower end plate cover 170S-3 in the third modification has a portion facing the lower discharge hole 190S, and a cutout portion 171*e* for which the sidewall 171*b* on the through-hole 145 side of the lower end plate cover 170S-3 is cut out, is formed. As illustrated in FIG. 20, in the bulging portion 171S-3, the peripheral edge portion 171*a* except for the cutout portion 171*e* is in contact with the lower surface of the lower end plate 160S, and the cutout portion 171*e* is abutted against the outer peripheral surface of the sub-bearing portion 161S.

Furthermore, as illustrated in FIG. 18 and FIG. 19, in the bulging portion 171S-3, the interval that a pair of sidewalls 171*b* faces each other is, in the radial direction of the rotating shaft 15, expanded toward the outer peripheral side from the inner peripheral side of the lower end plate cover 170S-3. In the third modification, as compared with the embodiment and the second modification, the change in the interval that the pair of sidewalls 171*b* faces each other is steeply formed. Thus, the refrigerant discharged from the lower discharge hole 190S and the refrigerant in the bulging portion 171S-3, are made to flow further easily toward the refrigerant passage holes 136A and 136B side arranged on the outer peripheral side of the lower end plate 160S along the pair of sidewalls 171*b* of the bulging portion 171S.

According to the third modification, because the bulging portion 171S-3 has the cutout portion 171*e*, although the airtightness in the bulging portion 171S-3 is reduced as compared with the embodiment and the first and the second modifications, there is no influence even if the refrigerant is slightly leaked into the compressor housing 10 from between the bulging portion 171S-3 and the sub-bearing portion 161S, and the workability of the bulging portion 171S-3 can be improved. In the third modification also, the same effect as that in the embodiment can be obtained.

Although not illustrated, the above-described third embodiment is not limited to the configuration for which the cutout portion 171*e* of the bulging portion 171S-3 is abutted against the outer peripheral surface of the sub-bearing portion 161S. For example, in order to improve the airtightness in the bulging portion 171S-3, the bulging portion 171S-3 may be formed so as to extend from the cutout portion 171*e* along the outer peripheral surface of the sub-bearing portion 161S and cover the outer peripheral surface of the sub-bearing portion 161S. Furthermore, a configuration for which a part of the bulging portion 171S-3 thus covers the sub-bearing portion 161S may be applied to the above-described embodiment and the first and the second modifications.

Fourth Modification

Figure 21:
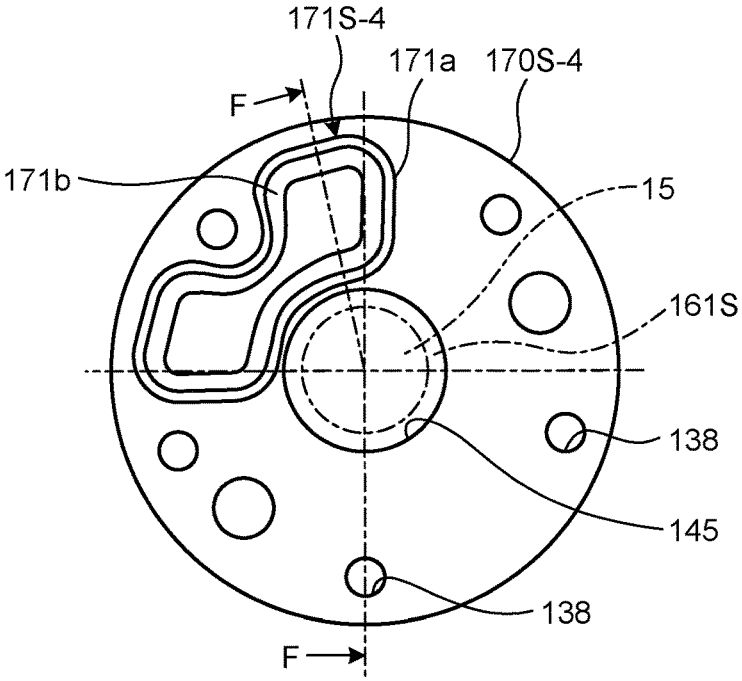
FIG. 21 is a plan view of a lower end plate cover in a rotary compressor of a fourth modification as viewed from above.
Figure 22:
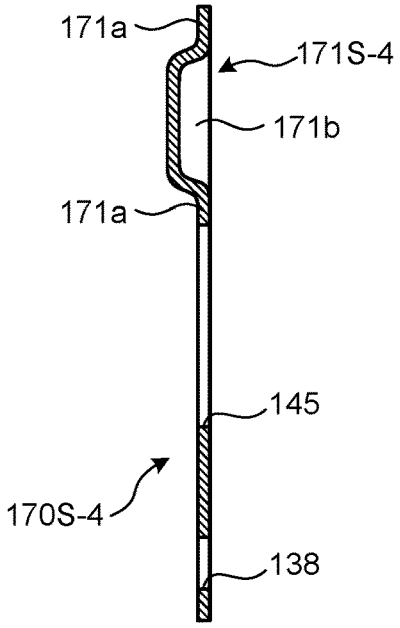
FIG. 22 is a cross-sectional view illustrating the lower end plate cover in the rotary compressor of the fourth modification viewed along the F-F line in FIG. 21.
Figure 23:
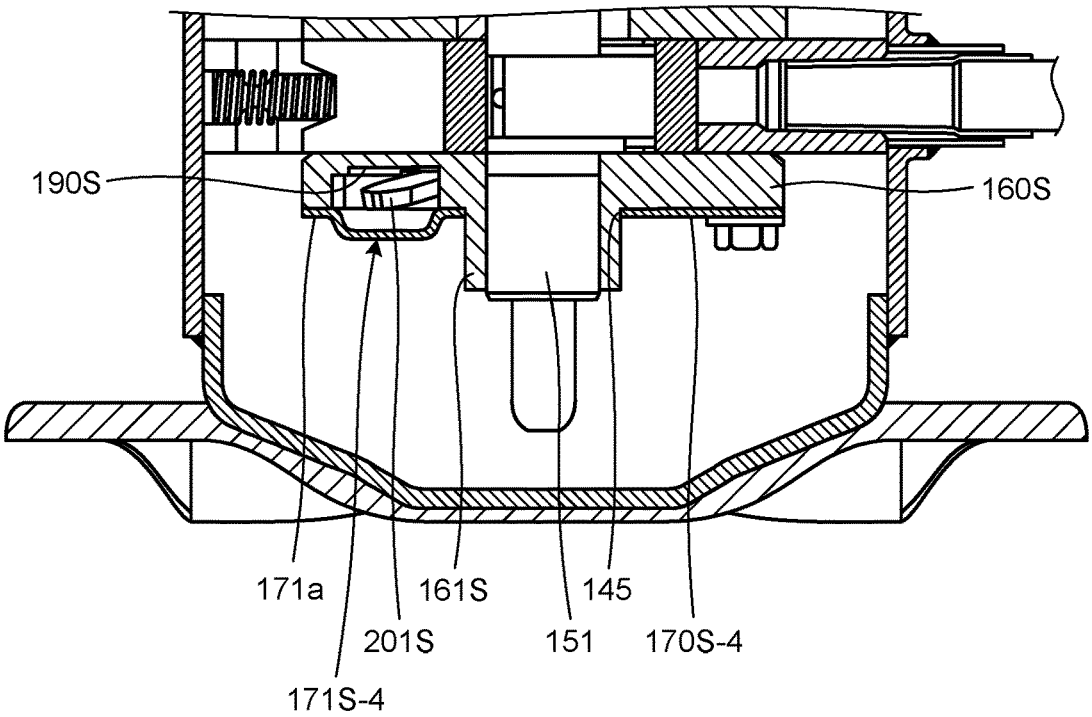
FIG. 23 is a longitudinal sectional view illustrating a principal portion in the rotary compressor of the fourth modification.

FIG. 21 is a plan view of a lower end plate cover in a rotary compressor of the fourth modification as viewed from above. FIG. 22 is a cross-sectional view illustrating the lower end plate cover in the rotary compressor of the fourth modification viewed along the F-F line in FIG. 21. FIG. 23 is a longitudinal sectional view illustrating a principal portion of the rotary compressor of the fourth modification.

As illustrated in FIG. 21 and FIG. 22, a bulging portion 171S-4 included in a lower end plate cover 170S-4 in the fourth modification has a portion facing the lower discharge hole 190S. At least a part of the bulging portion 171S-4 is, in a cross section orthogonal to the shaft direction of the rotating shaft 15, formed overlapping each of the lower discharge-chamber recessed portion 163S and the lower discharge-valve accommodating recessed portion 164S (see FIG. 3). Thus, in the bulging portion 171S-4, because the volume is ensured by expanding the area occupying the cross section orthogonal to the shaft direction of the rotating shaft 15, the depth in the thickness direction of the lower end plate cover 170S-4 can be formed shallow. Furthermore, because the bulging portion 171S-4 is formed in a shape including a portion for which the volume in the cross section orthogonal to the shaft direction of the rotating shaft 15 is changed, that is, what is called a throttle portion, it is possible to disturb the flow of the refrigerant in the lower end-plate cover chamber 180S and to adjust the flow of the refrigerant as appropriate.

As illustrated in FIG. 23, the bulging portion 171S-4 of the lower end plate cover 170S-4 is in contact with the lower surface of the lower end plate 160S over the entire peripheral edge portion 171*a* of the bulging portion 171S-4. As a result, the airtightness in the bulging portion 171S-4 is enhanced.

According to the fourth modification, as at least a part of the bulging portion 171S-4 is formed to overlap each of the lower discharge-chamber recessed portion 163S and the lower discharge-valve accommodating recessed portion 164S, the volume of the bulging portion 171S-4 is increased, and thus the bulging portion 171S-4 can be formed in a shallow depth. In the fourth modification also, the same effect as that in the embodiment can be obtained.

REFERENCE SIGNS LIST

1 ROTARY COMPRESSOR
10 COMPRESSOR HOUSING
11 MOTOR
12 COMPRESSION UNIT
15 ROTATING SHAFT
105 UPPER SUCTION PIPE (SUCTION PORTION)
104 LOWER SUCTION PIPE (SUCTION PORTION)
107 DISCHARGE PIPE (DISCHARGE PORTION)
121T UPPER CYLINDER
121S LOWER CYLINDER
125T UPPER PISTON
125S LOWER PISTON
127T UPPER VANE
127S LOWER VANE
128T UPPER VANE GROOVE
128S LOWER VANE GROOVE
130T UPPER CYLINDER CHAMBER
130S LOWER CYLINDER CHAMBER
131T UPPER SUCTION CHAMBER
131S LOWER SUCTION CHAMBER
133T UPPER COMPRESSION CHAMBER
133S LOWER COMPRESSION CHAMBER
136 REFRIGERANT PASSAGE HOLE (REFRIGERANT COMMUNICATING HOLE)
140 INTERMEDIATE PARTITION PLATE
160T UPPER END PLATE
160S LOWER END PLATE
163T UPPER DISCHARGE-CHAMBER RECESSED PORTION
163S LOWER DISCHARGE-CHAMBER RECESSED PORTION
164T UPPER DISCHARGE-VALVE ACCOMMODATING RECESSED PORTION
164S LOWER DISCHARGE-VALVE ACCOMMODATING RECESSED PORTION
170S LOWER END PLATE COVER
171S BULGING PORTION
171*a* PERIPHERAL EDGE PORTION
171*b* SIDEWALL
171*c* OUTER PERIPHERAL-SIDE CORNER PORTION
171*d* INNER PERIPHERAL-SIDE CORNER PORTION
171*e* CUTOUT PORTION
180T UPPER END-PLATE COVER CHAMBER
180S LOWER END-PLATE COVER CHAMBER
190T UPPER DISCHARGE HOLE
190S LOWER DISCHARGE HOLE
200T UPPER DISCHARGE VALVE
200S LOWER DISCHARGE VALVE

The invention claimed is:

1. A rotary compressor comprising:

a sealed and vertical cylindrical compressor housing provided with a refrigerant discharge portion at an upper portion and a refrigerant suction portion at a lower portion;

a compression unit arranged at a lower portion of the compressor housing and configured to compress refrigerant that is sucked from the suction portion and to discharge the refrigerant from the discharge portion; and a motor arranged at an upper portion of the compressor housing and configured to drive the compression unit, wherein the compression unit includes an annular upper cylinder and an annular lower cylinder, an upper end plate closing an upper side of the upper cylinder, and a lower end plate closing a lower side of the lower cylinder, an intermediate partition plate arranged between the upper cylinder and the lower cylinder, and closing a lower side of the upper cylinder and an upper side of the lower cylinder, a rotating shaft supported by a main bearing portion provided on the upper end plate and by a sub-bearing portion provided on the lower end plate, and rotated by the motor, an upper eccentric portion and a lower eccentric portion provided on the rotating shaft with a phase difference of 180 degrees from each other, an upper piston fitted in the upper eccentric portion and configured to revolve along an inner peripheral surface of the upper cylinder and form an upper cylinder chamber in the upper cylinder, a lower piston fitted in the lower eccentric portion and configured to revolve along an inner peripheral surface of the lower cylinder and form a lower cylinder chamber in the lower cylinder, an upper vane projecting into the upper cylinder chamber from an upper vane groove provided on the upper cylinder, and brought into contact with the upper piston so as to section the upper cylinder chamber into an upper suction chamber and an upper compression chamber, a lower vane projecting into the lower cylinder chamber from a lower vane groove provided on the lower cylinder, and brought into contact with the lower piston so as to section the lower cylinder chamber into a lower suction chamber and a lower compression chamber, an upper end plate cover covering the upper end plate, forming an upper end-plate cover chamber between the upper end plate and the upper end plate cover, and having an upper end-plate cover discharge hole communicating with the upper end-plate cover chamber and an inside of the compressor housing, a lower end plate cover covering the lower end plate and forming a lower end-plate cover chamber between the lower end plate and the lower end plate cover, an upper discharge hole provided on the upper end plate and communicating with the upper compression chamber and the upper end-plate cover chamber, a lower discharge hole provided on the lower end plate and communicating with the lower compression chamber and the lower end-plate cover chamber, and a refrigerant passage hole running through the lower end plate, the lower cylinder, the intermediate partition plate, the upper end plate, and the upper cylinder, and communicating with the lower end-plate cover chamber and the upper end-plate cover chamber, the lower end plate includes a lower discharge valve of a reed valve type configured to open and close the lower discharge hole, a lower discharge-valve accommodating recessed portion that extends in a groove shape from the lower discharge hole and into which the lower discharge valve is accommodated, and a lower discharge-chamber recessed portion formed so as to overlap with the lower discharge hole side of the lower discharge-valve accommodating recessed portion and communicate with the refrigerant passage hole, the lower end plate cover is formed in a flat-plate shape and is provided with a bulging portion having a portion facing the lower discharge hole, the lower end-plate cover chamber is formed by the lower discharge-valve accommodating recessed portion, the lower discharge-chamber recessed portion, and the bulging portion, and the bulging portion has a volume of 1/18 or greater and 1/9 or less of a total of air volumes of the upper compression chamber and the lower compression chamber.

2. The rotary compressor according to claim 1, wherein the bulging portion of the lower end plate cover is in contact with a lower surface of the lower end plate over an entire peripheral edge portion of the bulging portion.

3. The rotary compressor according to claim 1, wherein a part of the bulging portion is abutted against an outer peripheral surface of the sub-bearing portion of the lower end plate.

4. The rotary compressor according to claim 1, wherein the bulging portion has a pair of opposing sidewalls, and an interval that the pair of sidewalls faces each other is, in a radial direction of the rotating shaft, expanded toward an outer peripheral side from an inner peripheral side of the lower end plate cover.

5. The rotary compressor according to claim 1, wherein, in the bulging portion of the lower end plate cover, in a radial direction of the rotating shaft, a curvature of an outer peripheral-side corner portion located on an outer peripheral side of the lower end plate cover is greater than the curvature of an inner peripheral-side corner portion located on an inner peripheral side of the lower end plate cover.

6. The rotary compressor according to claim 1, wherein at least a part of the bulging portion of the lower end plate cover is formed so as to overlap with the lower discharge-chamber recessed portion and the lower discharge-valve accommodating recessed portion, in a cross section orthogonal to a shaft direction of the rotating shaft.

* * * * *